US010935910B2

(12) United States Patent
Akamatsu

(10) Patent No.: US 10,935,910 B2
(45) Date of Patent: Mar. 2, 2021

(54) IMAGE FORMING APPARATUS IN WHICH CORRUGATED SHAPE IS FORMED IN WIDTH DIRECTION ON SHEET TO WHICH AIR IS BLOWN

(71) Applicant: CANON KABUSHIKI KAISHA, Tokyo (JP)

(72) Inventor: Yuki Akamatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/819,279

(22) Filed: Mar. 16, 2020

(65) Prior Publication Data

US 2020/0218180 A1 Jul. 9, 2020

Related U.S. Application Data

(63) Continuation of application No. PCT/JP2018/036544, filed on Sep. 28, 2018.

(30) Foreign Application Priority Data

Sep. 29, 2017 (JP) ..... JP2017-190080

(51) Int. Cl.
*G03G 15/00* (2006.01)
*B65H 29/00* (2006.01)
(Continued)

(52) U.S. Cl.
CPC ..... *G03G 15/2017* (2013.01); *B65H 29/245* (2013.01); *B65H 29/70* (2013.01);
(Continued)

(58) Field of Classification Search
CPC ..... G03G 15/6552; G03G 15/6573; G03G 21/206; G03G 2215/00421;
(Continued)

(56) References Cited

U.S. PATENT DOCUMENTS 3,212,775 A * 10/1965 Taylor, Jr. ..... B65H 29/70 271/188
5,788,229 A * 8/1998 Asami ..... B65H 29/70 271/188
(Continued)

FOREIGN PATENT DOCUMENTS

CN 103207556 A 7/2013
DE 102006017461 A1 * 11/2006 ..... B65H 29/245
(Continued)

OTHER PUBLICATIONS

Nov. 6, 2018 International Search Report in International Patent Appln. No. PCT/JP2018/036544.

*Primary Examiner* — Robert B Beatty
(74) *Attorney, Agent, or Firm* — Venable LLP

(57) ABSTRACT

Disclosed is an image forming apparatus, including: a first guide guiding one surface of a sheet downstream of a fixing unit fixing a toner image on the sheet and upstream of discharging rollers discharging the sheet to a stacking portion in a sheet conveying direction; a second guide facing the first guide, the second guide guiding the other surface of the sheet; protrusions with openings provided on the second guide in a sheet width direction orthogonal to the sheet conveying direction; recesses provided on the first guide in the sheet width direction, the recesses facing the protrusions; and a blower unit blowing air toward the sheet via the openings provided on the second guide, wherein a corrugated shape is formed in the width direction on the sheet to which air is blown by the protrusions provided on the second guide and the recesses provided on the first guide.

10 Claims, 5 Drawing Sheets

(51) Int. Cl.
*G03G 15/20* (2006.01)
*B65H 29/24* (2006.01)
*B65H 29/70* (2006.01)

(52) U.S. Cl.
CPC . *G03G 15/6573* (2013.01); *B65H 2301/5122* (2013.01); *G03G 2215/00421* (2013.01); *G03G 2215/00704* (2013.01)

(58) Field of Classification Search
CPC . G03G 2215/00704; G03G 2221/1645; B65H 29/12; B65H 29/125; B65H 29/20; B65H 29/24; B65H 29/245; B65H 2301/5122; B65H 2601/251; B65H 2801/06; B65H 29/70
USPC ..... 399/92, 401, 405; 271/188
See application file for complete search history.

(56) References Cited

U.S. PATENT DOCUMENTS 6,398,206 B1 * 6/2002 Yang ..... B65H 3/0883 271/107
6,659,603 B2 * 12/2003 Kida ..... B41J 11/005 271/188
8,396,382 B2 3/2013 Mori et al.
8,989,614 B2 3/2015 Yokokawa
9,772,589 B2 9/2017 Akamatsu
2006/0290048 A1 * 12/2006 Dobashi ..... B65H 3/128 271/94
2008/0101830 A1 * 5/2008 Sato ..... G03G 15/6573 399/331
2011/0229166 A1 9/2011 Mori et al.
2013/0183059 A1 7/2013 Yokokawa
2013/0300053 A1 * 11/2013 Otsuka ..... B65H 29/24 271/103
2015/0110528 A1 * 4/2015 Kuma ..... G03G 15/657 399/315
2016/0257136 A1 * 9/2016 Ueno ..... B41J 3/60
2018/0015740 A1 * 1/2018 Kodama ..... G03G 15/6576

FOREIGN PATENT DOCUMENTS

JP 2003212371 A * 7/2003 ..... G01N 3/20
JP 2010-215311 A 9/2010
JP 2011-197108 A 10/2011
JP 2012-098448 A 5/2012
JP 2012098448 A * 5/2012
JP 2013-167869 A 8/2013

* cited by examiner

IMAGE FORMING APPARATUS IN WHICH CORRUGATED SHAPE IS FORMED IN WIDTH DIRECTION ON SHEET TO WHICH AIR IS BLOWN

CROSS-REFERENCE TO RELATED APPLICATIONS

This application is a Continuation of International Patent Application No. PCT/JP2018/036544, filed Sep. 28, 2018, which claims the benefit of Japanese Patent Application No. 2017-190080, filed Sep. 29, 2017, both of which are hereby incorporated by reference herein in their entirety.

BACKGROUND OF THE INVENTION

Field of the Invention

The present invention relates to an image forming apparatus that cools a sheet to be discharged to a stacking portion with air.

Background Art

In a conventional image forming apparatus such as a copying machine, when duplex printing is performed, toner is heated and fixed on the obverse surface and the reverse surface of a sheet and the sheet is discharged. In this case, the sheet heated in the fixing portion retains heat even after having been discharged to the stacking portion by the discharging portion and having been stacked. If the sheet is discharged at a temperature higher than the temperature at which the toner on the sheet is melted, portions of toner melt and fix to each other in the state where the sheets are stacked at the stacking portion, which may cause a problem that the sheets are stuck to each other.

In order to solve this problem, a cooling device is provided at a sheet conveying path from the fixing portion to the discharging portion as disclosed in Patent Document 1 or at the discharging portion as disclosed in Patent Document 2.

However, in recent years, high-speed apparatuses have become mainstream in which a sheet is conveyed at a high speed and accordingly toner on the sheet is fixed in a short time. This necessitates a higher temperature in the fixing portion. Further, the time for the sheet to be discharged after the sheet has passed through the fixing portion has become shorter and shorter. Therefore, in the conventional configurations described above, the cooling device cannot sufficiently cool the sheet, and the toner is discharged at a temperature higher than the temperature at which the toner melts. As a result, a problem may occur that the sheets are stuck to each other.

CITATION LIST

Patent Literature

Patent Document 1: Japanese Patent Application Laid-Open Publication No. 2010-215311

Patent Document 2: Japanese Patent Application Laid-Open Publication No. 2011-197108

SUMMARY OF THE INVENTION

An object of the present invention is to reduce the temperature of the sheets to suppress the sheets from sticking to each other (melt-adhesion).

In order to accomplish the above object, an image forming apparatus according to the present invention, comprising:

a transferring portion configured to transfer a toner image onto a sheet;

a fixing unit configured to fix the toner image on the sheet;

a plurality of discharging rollers which discharge the sheet to a stacking portion;

a first guide member configured to guide one surface of the sheet downstream of the fixing unit in a sheet conveying direction and upstream of the plurality of discharging rollers in the sheet conveying direction;

a second guide member placed to face the first guide member, the second member being configured to guide the other surface of the sheet downstream of the fixing unit in the sheet conveying direction and upstream of the plurality of discharging rollers in the sheet conveying direction;

a plurality of protruded portions provided on the second guide member in a sheet width direction orthogonal to the sheet conveying direction, the plurality of protruded portions having openings through which air passes;

a plurality of recessed portions provided on the first guide member in the sheet width direction, the plurality of recessed portions being respectively located so as to face the plurality of protruded portions; and a blower unit which blows air toward the sheet via the openings provided on the protruded portions of the second guide member, wherein by the plurality of protruded portions provided on the second guide member and the plurality of recessed portions provided on the first guide member, a corrugated shape is formed in the width direction on the sheet to which air is blown, the plurality of recessed portions facing the plurality of protruded portions.

According to the present invention, it is possible to reduce the temperature of the sheets to suppress the sheets from sticking to each other (melt-adhesion).

Further features of the present invention will become apparent from the following description of exemplary embodiments with reference to the attached drawings.

DESCRIPTION OF THE EMBODIMENTS

Hereinafter, preferred embodiments of the present invention will be illustratively described in detail with reference to the drawings. However, dimensions, materials, shapes, relative arrangements and the like of the components described in the following embodiments should be appropriately changed depending on the configuration and various conditions of the apparatus to which the present invention is applied. Therefore, the scope of the present invention is not intended to be limited thereto unless otherwise specified.

First Embodiment (Description of Overall Configuration of the Apparatus)

Figure 1:
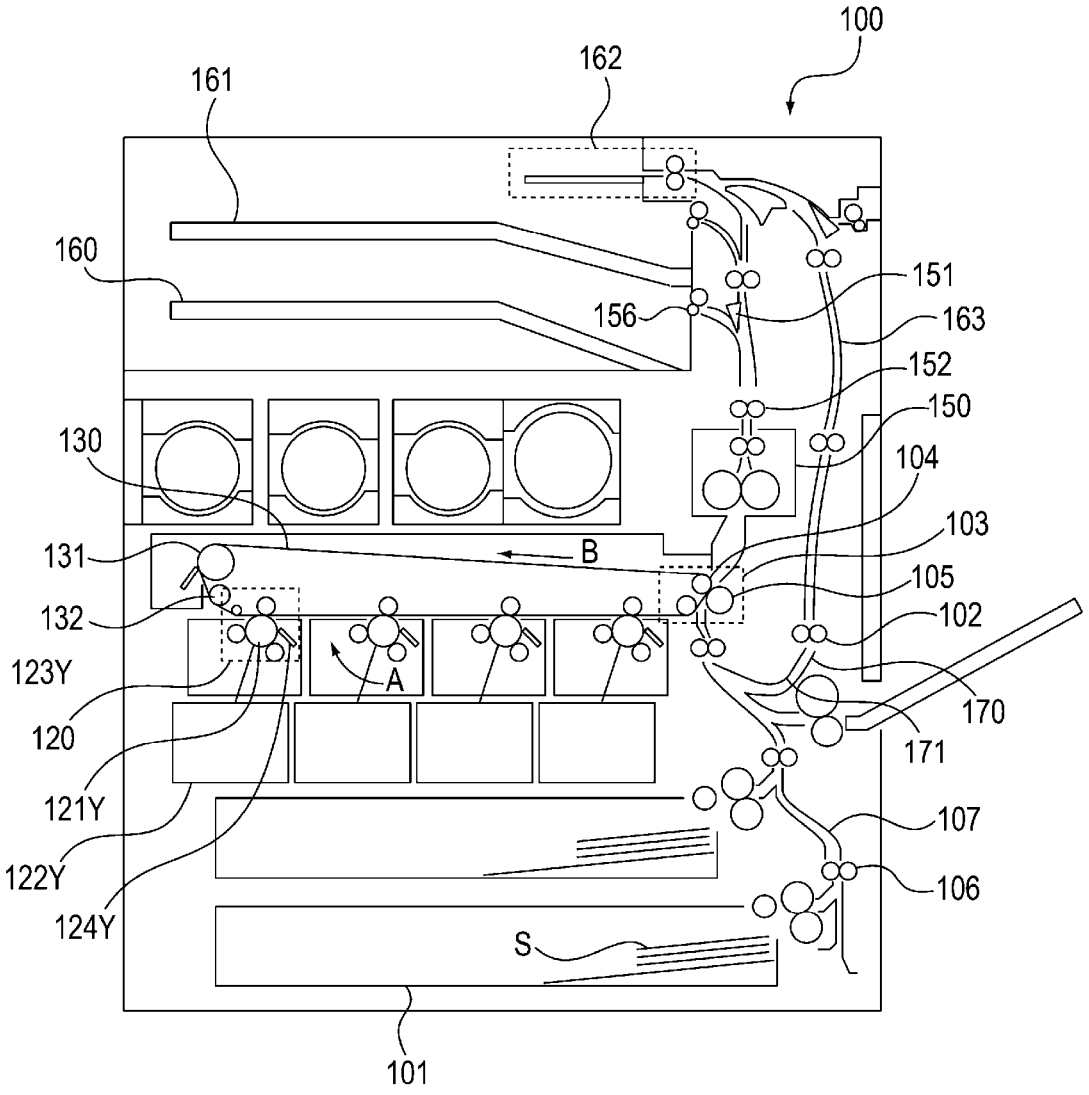
FIG. 1 is a schematic cross-sectional view showing an image forming apparatus.

The entire configuration of the image forming apparatus according to the present embodiment will be described with reference to drawings. FIG. 1 is a schematic cross-sectional view illustrating an overall configuration of an image forming apparatus 100 according to the present embodiment.

In the image forming apparatus 100 in FIG. 1, sheets S (for example, recording sheets, plastic sheets, cloth sheets or the like) are stacked and stored on a lift-up provided in the sheet storage 101 working as a sheet stacking portion. Each of the sheets S stored in the sheet storage is sent out by a sheet feeding mechanism working as a pickup portion. After a skew correction is performed for the fed sheet S at the registration unit 102, the sheet S passes through the conveying unit, and is sent to the secondary transfer portion 103. The secondary transfer portion 103 is a toner image transfer nip portion constituted by the secondary transfer inner roller 104 and the secondary transfer outer roller 105, which are opposed to each other. At the secondary transfer portion, an unfixed image (toner image) is attracted to the sheet surface by applying a predetermined pressing force and an electrostatic additional bias. The conveying path for conveying the sheet S is constituted by the sheet conveying portions 106 (such as a pair of rollers and a suction belt) arranged at an appropriate interval for conveying the sheet S while holding the sheet S and the sheet guide 107 for guiding the sheet while stabilizing the behavior of the sheet S.

A description will be given of a process of forming an image sent to the secondary transfer unit 103 at the same timing as the process of conveying the sheet S to the secondary transfer unit 103. The image forming unit 120 mainly includes the photosensitive body 121, the exposure mechanism 122, a developing mechanism (not shown), the primary transfer mechanism 123, and the photosensitive body cleaner 124. Based on a received signal of image information, the exposure mechanism 122 emits light to the photosensitive body 121 via a diffraction portion (not shown), if necessary, to form an electrostatic latent image while the photosensitive body 121 rotates in the direction indicated by the arrow A in the drawing. The surface of the photosensitive body 121 has been uniformly charged by a charging portion (not shown) in advance.

The electrostatic latent image formed on the photosensitive body 121 as described above is developed with toner by the developing mechanism so that a toner image is formed on the photosensitive body 121. Thereafter, a predetermined pressing force and an electrostatic bias are applied to the intermediate transfer belt 130 by the primary transfer mechanism 123 so that the toner image formed on the photosensitive body 121 is transferred onto the intermediate transfer belt 130. Thereafter, the transfer residual toner slightly remaining on the photosensitive body 121 is collected by the photosensitive body cleaner 124 for preparing for the next image formation. The image forming apparatus shown in FIG. 1 has four sets of the image forming units 120 corresponding to the colors of yellow (Y), magenta (M), cyan (C), and black (Bk) respectively. The number of colors is not limited to four, and the order of the colors is not limited to this order. In FIG. 1, reference numerals are given only for the image forming portion of yellow (Y). However, the image forming portions for the other colors are configured similarly to that of yellow (Y).

Next, the intermediate transfer belt 130 will be described. The intermediate transfer belt 130 is stretched by rollers such as the drive roller 131, the tension roller 132, and the secondary transfer inner roller 104, and is moved in the direction of the arrow B in the drawing for conveyance. Accordingly, the image forming processes of the respective colors, which are performed in parallel by the image forming portions 120 of Y, M, C and Bk are performed at such timings that an image formed by each of the image forming portions overlaps with upstream toner images of other colors which have already been transferred onto the intermediate transfer belt 130. As a result, a full-color toner image is finally formed on the intermediate transfer belt 130 and is conveyed to the secondary transfer portion 103.

A full-color toner image is collectively transferred on a sheet at the secondary transfer portion 103 through the above-described conveying process of the sheet S and image forming process for the sheet S. The sheet S to which the toner image has been transferred is conveyed to the fixing portion (fixing unit) 150, where the toner image is melted and fixed by being pressed and heated by the fixing portion 150. A conveying path is selected (switched) by the conveyance branch mechanism 151 for the sheet S with the fixed image obtained as described above. That is, a conveying path for the sheet S is selected such that the sheet S is discharged onto the discharge trays 160 and 161 by a discharging portion described later or the sheet S is conveyed from the reverse conveying mechanism 162 to the duplex conveying mechanism 163. The sheet S conveyed to the duplex conveying mechanism 163 is conveyed again to the secondary transfer portion 103 where an image is formed on the second surface in a similar way for that on the first surface. The sheet S on whose second surface an image has been fixed is further conveyed, and is selectively discharged to one of the discharge trays 160 and 161 by the discharging portion.

(Description of Discharging Portion)

Figure 2A:
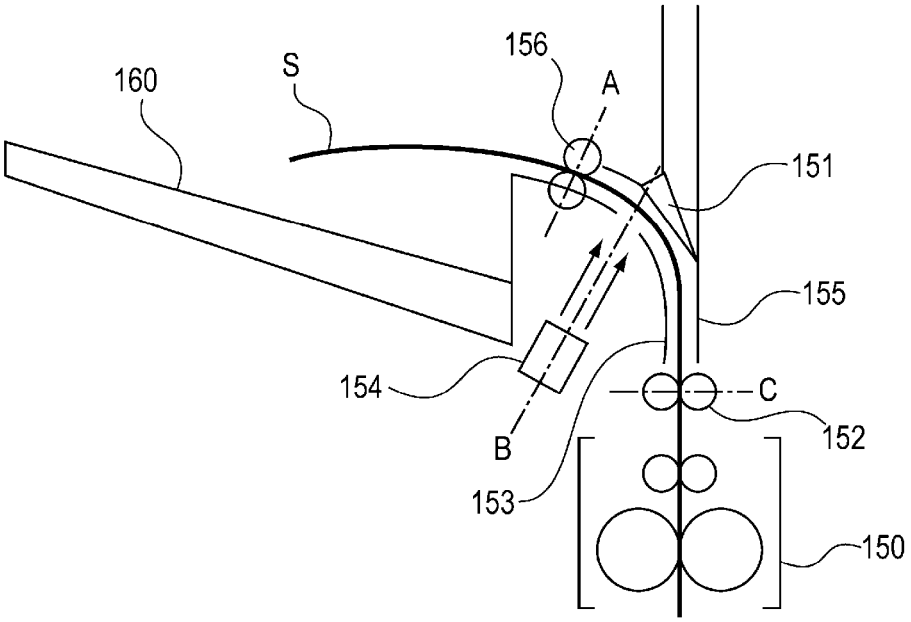
FIG. 2A is a cross-sectional view showing a discharging portion according to the first embodiment of the present invention.
Figure 2B:
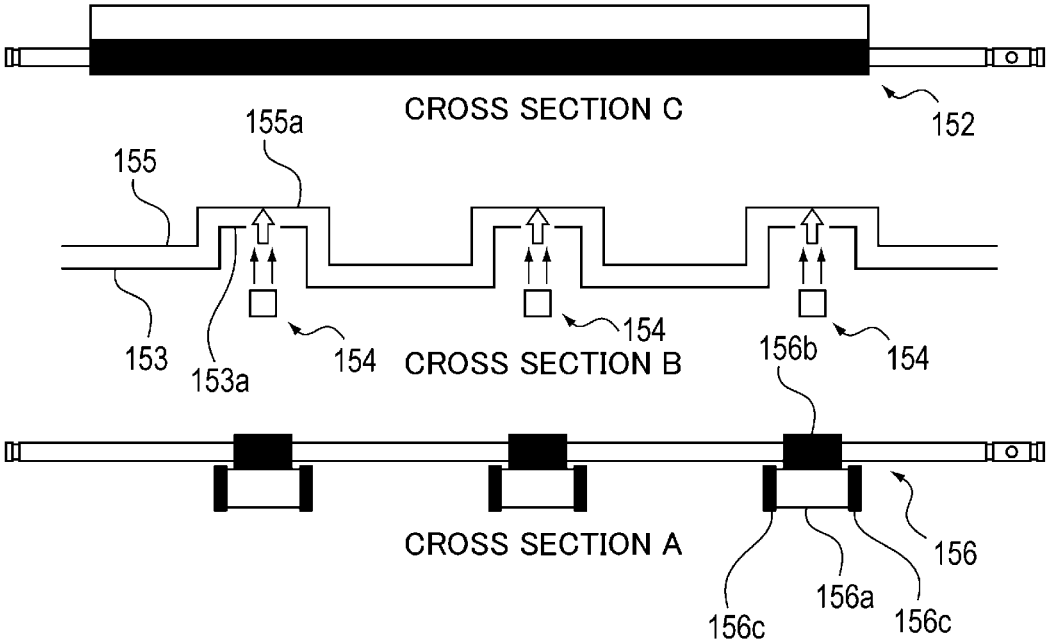
FIG. 2B is a cross-sectional view showing this discharging portion in a conveying direction.

Next, a discharging portion (sheet discharging device) will be described with reference to drawings, which conveys the sheet that has passed through the fixing portion 150 and discharges it onto the discharge trays 160 and 161 working as a stacking portion. A description will be made assuming that the sheet S is discharged to the discharge tray 160. FIG. 2A is a cross-sectional view of the discharging portion according to the present embodiment. FIG. 2B includes cross-sectional views at the positions A, B, and C of the discharging portion shown in FIG. 2A, which views are seen from the direction in which the sheet S is conveyed.

As shown in FIG. 2A, the discharging portion as a sheet discharging device includes the conveying rollers 152, the discharging rollers 156, the inner guide 153, the outer guide 155, and the obverse surface cooling device 154. The conveying rollers 152 for conveying the sheet are provided downstream of the fixing portion 150 in the sheet conveying direction. The pair of discharging rollers 156 is provided downstream of the conveying roller 152 in the sheet conveying direction and nips the sheet and discharge it onto the discharge trays 160 and 161. The inner guide 153 is provided between the conveying rollers 152 and the discharging rollers 156, and is a first guide member that guides one surface of the sheet. The outer guide 155 is provided between the conveying rollers 152 and the discharging rollers 156, and is a second guide member that faces the inner guide 153 and guides the other surface of the sheet. The obverse surface cooling device 154 is a blower unit that blows air to a sheet conveyed along a conveying path formed by the inner guide 153 and the outer guide 155 between the conveying rollers 152 and the discharging rollers 156.

As shown in the cross-section B of FIG. 2B, the inner guide 153 is provided with a plurality of protruded portions 153*a* in the width direction orthogonal to the sheet conveying direction. The plurality of protruded portions 153*a* are provided with openings through which air passes. The outer guide 155 is provided with a plurality of recessed portions 155*a* at positions corresponding to the protruded portions 153*a* in the width direction orthogonal to the sheet conveying direction. Further, the obverse surface cooling device 154 is provided at a more inner position than that of the inner guide 153 between the conveying rollers 152 and the discharging rollers 156. The obverse surface cooling device 154 blows air to the positions corresponding to the protruded portions 153*a* of the inner guide 153 from one surface side of the sheet.

As shown in the cross-section C of FIG. 2B, the conveying rollers 152 are in contact with substantially the entire area of the sheet in the width direction. Further, as shown in the cross-section A of FIG. 2B, the discharging rollers 156 are in a partial contact with a sheet in the width direction. Furthermore, the discharging rollers 156 include a pair of the roller 156*a* and the roller 156*b*, which nips and coveys the sheet and the outer diameter of one of the rollers 156*a* and the roller 156*b* is not constant. Specifically, the roller 156*a* of the discharging rollers 156 is provided with the ring members 156*c* at both ends of the roller 156*a* in the width direction of the roller 156*a*. The outer diameter of the ring members 156*c* is larger than the outer diameter of the roller 156*a*. Alternatively, the roller 156*a* may be provided with the single ring member 156*c* at one of the ends of the roller 156*a*.

At the discharging portion having the above-described configuration, the sheet S discharged from the fixing portion 150 is sent to the conveying rollers 152 and conveyed further by the conveying rollers 152. The sheet S conveyed by the conveying rollers 152 is introduced into a conveyance path for discharging the sheet to the discharge tray 160 by the conveyance branch mechanism 151 while being guided by the inner guide 153 and the outer guide 155 which are opposed to each other. Thereafter, the sheet S is cooled by blowing air from the obverse surface cooling device 154 provided at a more inner position than the inner guide 153 while being guided by the inner guide 153 and the outer guide 155 which are opposed to each other and then is discharged onto the discharge tray 160 by the discharging rollers 156.

Next, the state of the sheet S guided by the inner guide 153 and the outer guide 155 which are opposed to each other between the conveying rollers 152 and the discharging rollers 156 in the discharging portion according to the present embodiment will be described using a comparative example.

Figure 3A:
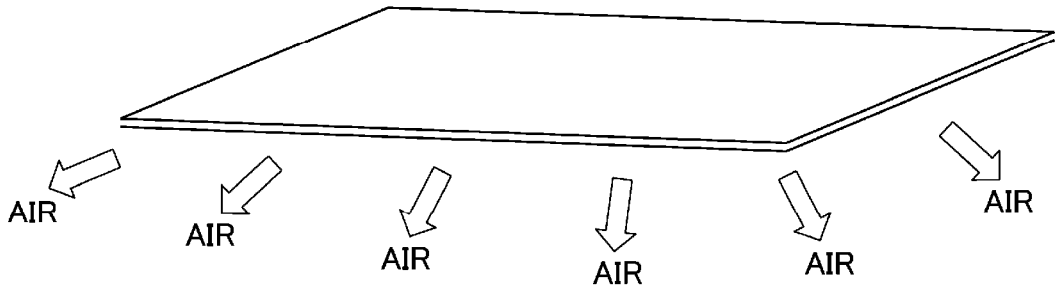
FIG. 3A PRIOR ART
FIG. 3A is a perspective view showing a state of a sheet of a comparative example (without application of the present invention)
Figure 3B:
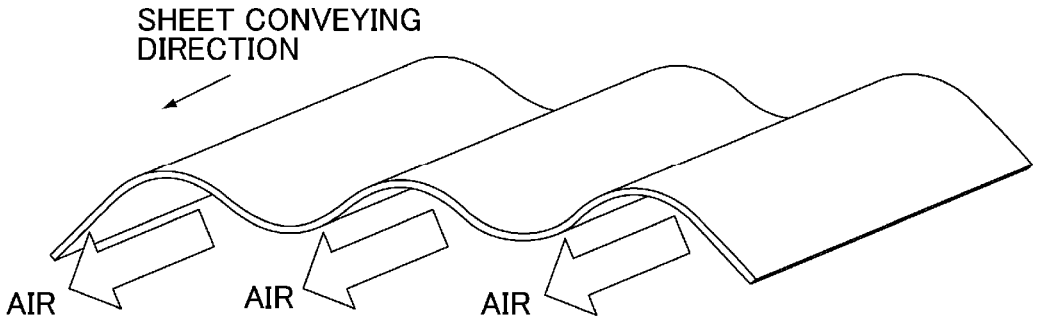
FIG. 3B is a perspective view showing a state of a sheet of an embodiment of the present invention (with application of the present invention).

FIG. 3A is a perspective view showing a state of a sheet when a discharging portion of a comparative example (in which the present invention is not applied) is used. FIG. 3B is a perspective view showing a state of a sheet when the discharge unit according to the present embodiment (in which the present invention is applied) is used. As described above, in the discharging portion of the present embodiment, the inner guide 153 and the outer guide 155, which are the two opposing conveying guides, have a recessed and protruded shape in the cross-section along the width direction orthogonal to the sheet conveying direction. In contrast, in the discharging portion of the comparative example, the inner guide 153 and the outer guide 155, which are two opposing conveying guides, have a linear shape in the cross-section along the width direction orthogonal to the sheet conveying direction.

In the discharging portion of the comparative example, when the sheet S is guided by the inner guide 153 and the outer guide 155, which are two opposing conveying guides, the inner guide 153 and the outer guide 155 have a linear shape in the cross-section in the width direction orthogonal to the conveying direction at the conveying guide. Therefore, as shown in FIG. 3A, even if air is blown from the obverse surface cooling device 154 toward the sheet, the air is dispersed in each direction (the direction of each arrow in FIG. 3A), so that the air permeates in the interior of the image forming apparatus.

In contrast to the above comparative example, when the sheet S is guided by the inner guide 153 and the outer guide 155, which are the two opposing conveyance guides, in the discharging portion of the present embodiment, the inner guide 153 and the outer guide 155 have a recessed and protruded shape in the cross-section (see FIG. 2B) in the width direction orthogonal to the conveying direction at the conveying guide. Therefore, as shown in FIG. 3B, a corrugated shape (a concave and convex shape) is formed on the sheet S in the width direction orthogonal to the conveying direction.

Each convex shape of the sheet S is formed along the conveying direction. When the obverse surface cooling device 154 blows air toward the sheet S having the corrugated shape, the blown air is guided along the conveying direction (each arrow direction in FIG. 3B) by each ridged portion (each convex portion) of the corrugated shape of the sheet S, so that the air is efficiently sent to the discharge tray 160 while suppressing the dispersion of air. That is, the air that has passed through the openings provided in the protruded portions 153*a* flows in the discharge direction along the convex shape of the sheet, passes through the position of the discharging roller 156, and is discharged outside the apparatus. The position of the discharging portion for discharging a sheet at which the air is also discharged out of the apparatus is vertically higher than the most upstream position in the conveying direction of the uppermost sheet of the bundle of the sheets stacked on the discharge tray 160. That is, the air discharged from the discharging portion of the sheet is blown onto the bundle of sheets stacked on the discharge tray 160.

As a result, the cooling effect of the air blown from the obverse surface cooling device 154 can be obtained not only in the conveying path by the inner guide 153 and the outer guide 155 but also on the discharge tray 160. Therefore, it is possible to reduce the temperature of the sheets on the discharge tray and suppress a problem that the sheets adhere to each other (melt-adhesion). It is preferable that the recessed portions 155*a* and the protruded portions 153*a* extend along the conveying direction for the corrugated shape to be properly formed on the sheet S.

Second Embodiment

In the discharging portion according to the second embodiment of the present invention, the pressing members 157 are used to form a corrugated shape on the sheet S in the width direction orthogonal to the conveying direction instead of the protruded and recessed shape of the conveying guide of the first embodiment of the present invention. In this embodiment, the same members as those in the first embodiment are denoted by the same reference numerals, and the description of the members having the same configuration and function is omitted.

In this embodiment, the outer guide 155 and the inner guide 153 are provided with ribs extending in the conveying direction. By providing these ribs, the area where the sheet contacts the outer guide 155 or the inner guide 153 can be reduced. That is, the resistance produced by the contact is reduced.

The openings through which the air passes are provided on the inner guide 153 between these ribs.

Figure 4A:
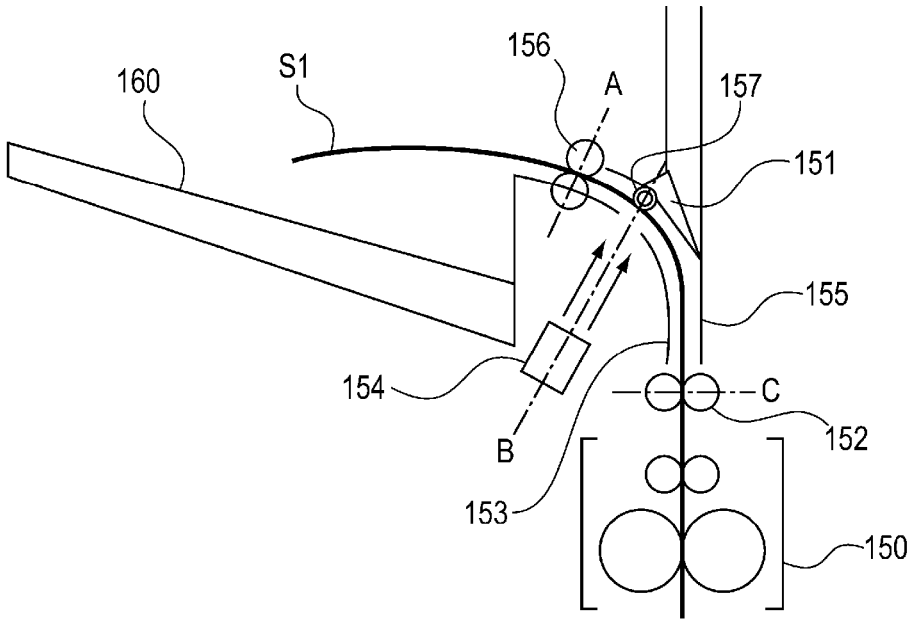
FIG. 4A is a cross-sectional view showing the discharging portion according to a second embodiment of the present invention and FIG. 4B is a cross-sectional view showing this discharging portion in the conveying direction.
Figure 4B:
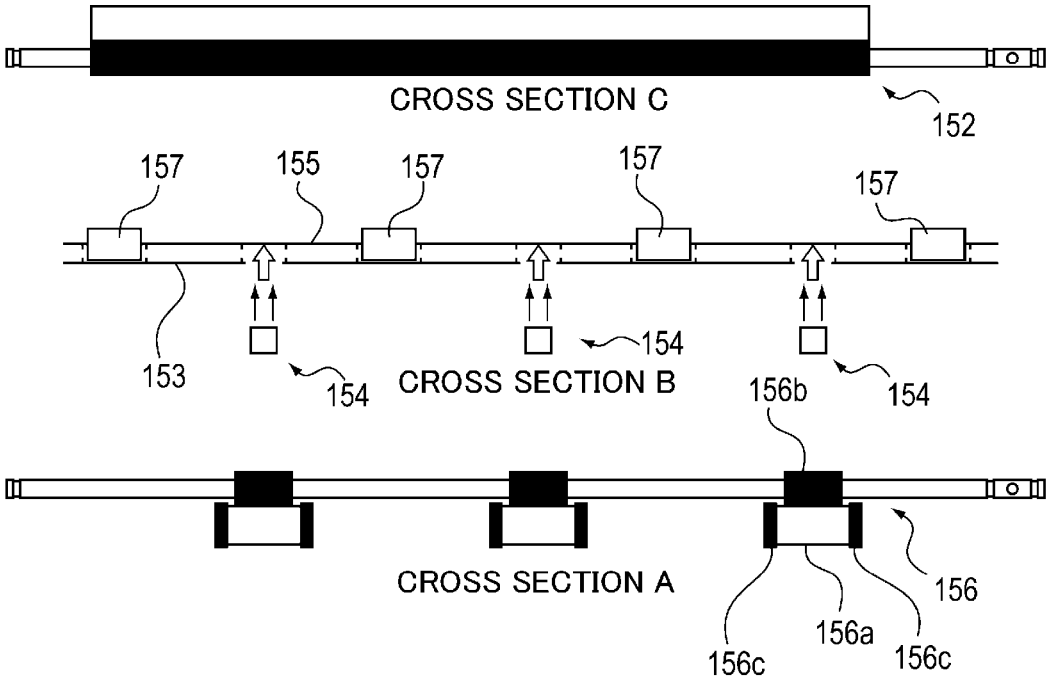

The discharging portion (sheet discharging device) that conveys the sheet that has passed through the fixing portion 150 and discharges the sheet onto the discharge trays 160 and 161 will be described with reference to FIGS. 4A and 4B. FIG. 4A is a cross-sectional view showing the discharging portion according to the present embodiment. FIG. 4B includes cross-sectional views at the positions A, B and C of the discharging portion shown in FIG. 4A, which views are seen from the direction in which the sheet S is conveyed.

As shown in the cross-section B of FIG. 4B, the pressing members 157 are provided on the side of the outer guide 155 at a plurality of positions in the width direction orthogonal to the sheet conveying direction. The pressing members 157 protrude from the side of the outer guide 155 (one guide member), and presses the sheet toward the inner guide 153 (the other guide member). In addition, the obverse surface cooling device 154 as a blowing unit that blows air to the sheet is provided between the conveying rollers 152 and the discharging rollers 156 on the side of the inner guide 153. The obverse surface cooling device 154 blows air to a plurality of positions where the pressing members 157 do not press the sheet in the width direction orthogonal to the sheet conveying direction. The pressing members 157 are, for example, rollers that are movable from the outer guide 155 toward the inner guide 153 and are urged toward the inner guide 153. When these rollers come into contact with the sheet, the rollers are rotated by the conveyance of the sheet. Then, when the conveyed sheet is a thick paper with high stiffness, the pressing members 157 are pressed by the conveyed sheet and moves to the side of the outer guide 155. Namely, the degree of the corrugated shape (the concave and convex shape) of the sheet S can be adjusted according to the stiffness of the sheet S, and the force applied to the sheet S can be adjusted by forming the corrugated shape.

Further, the conveying rollers 152 shown in the cross-section C of FIG. 4B and the discharging rollers 156 shown in the cross-section A of FIG. 4B have the same configurations as those in the first embodiment described above, and thus the description is omitted here.

In FIGS. 4A and 4B, the pressing members 157 are provided at positions corresponding to the openings through which air passes, but may be provided at other positions as long as they are located upstream of the discharge rollers 156 and downstream of the openings.

In the discharging portion having the above-described configuration, the sheet S discharged from the fixing portion 150 is sent to the conveying rollers 152 and further conveyed by the conveying rollers 152. The sheet S conveyed by the conveying rollers 152 is introduced into a conveying path for discharging the sheet to the discharge tray 160 by the conveyance branch mechanism 151 while being guided by the inner guide 153 and the outer guide 155 which are opposed to each other. Thereafter, the sheet S is pressed by the pressing members 157 provided so as to move toward the sheet S in the conveying path, is cooled by air blown from the obverse surface cooling device 154 provided at a more inner position than the inner guide 153, and is discharged to the discharge tray 160 by the discharge rollers 156 while being guided by the inner guide 153 and the outer guide 155 which are opposed to each other.

When the sheet S enters the area in which the pressing members 157 are provided, a corrugated shape (the concave and convex shape shown in FIG. 3B) is formed on the sheet S in the width direction orthogonal to the conveying direction. The obverse surface cooling device 154 blows air toward the sheet S on which the corrugated shape is formed. Accordingly, the blown air is guided along the conveying direction (the direction of arrows in FIG. 3B) by each ridged portion (each convex portion) of the corrugated shape of the sheet S. Accordingly, air is efficiently sent to the discharge tray 160 while suppressing the dispersion of air.

As a result, the cooling effect of the air blown from the obverse surface cooling device 154 can be obtained not only in the conveying path by the inner guide 153 and the outer guide 155 but also on the discharge tray 160. Therefore, it is possible to reduce the temperature of the sheets on the discharge tray so that the problem that the sheets adhere to each other (melt-adhesion) can be suppressed.

Third Embodiment

In the discharging portion according to the third embodiment of the present invention, the reverse surface cooling device 158 is used for forming a corrugated shape on the sheet S in the width direction orthogonal to the conveying direction instead of providing the recessed and protruded shape of the conveying guide of the first embodiment of the present invention. In this embodiment, the same members as those in the first embodiment are denoted by the same reference numerals, and the description of the members having the same configuration and function is omitted.

Figure 5A:
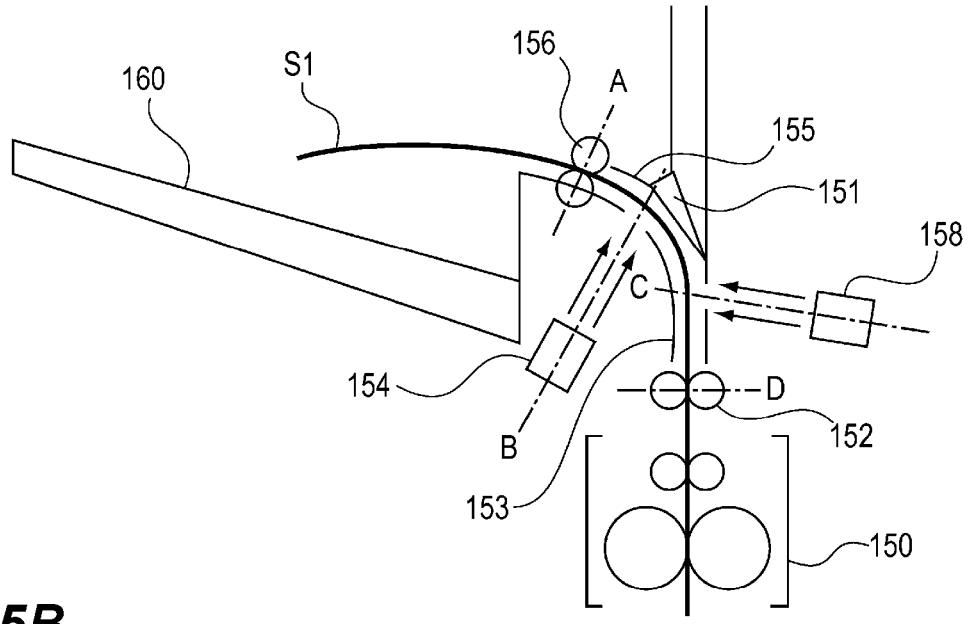
FIG. 5A is a cross-sectional view showing the discharging portion according to a third embodiment of the present invention and FIG. 5B is a cross-sectional view showing this discharging portion in the conveying direction.
Figure 5B:
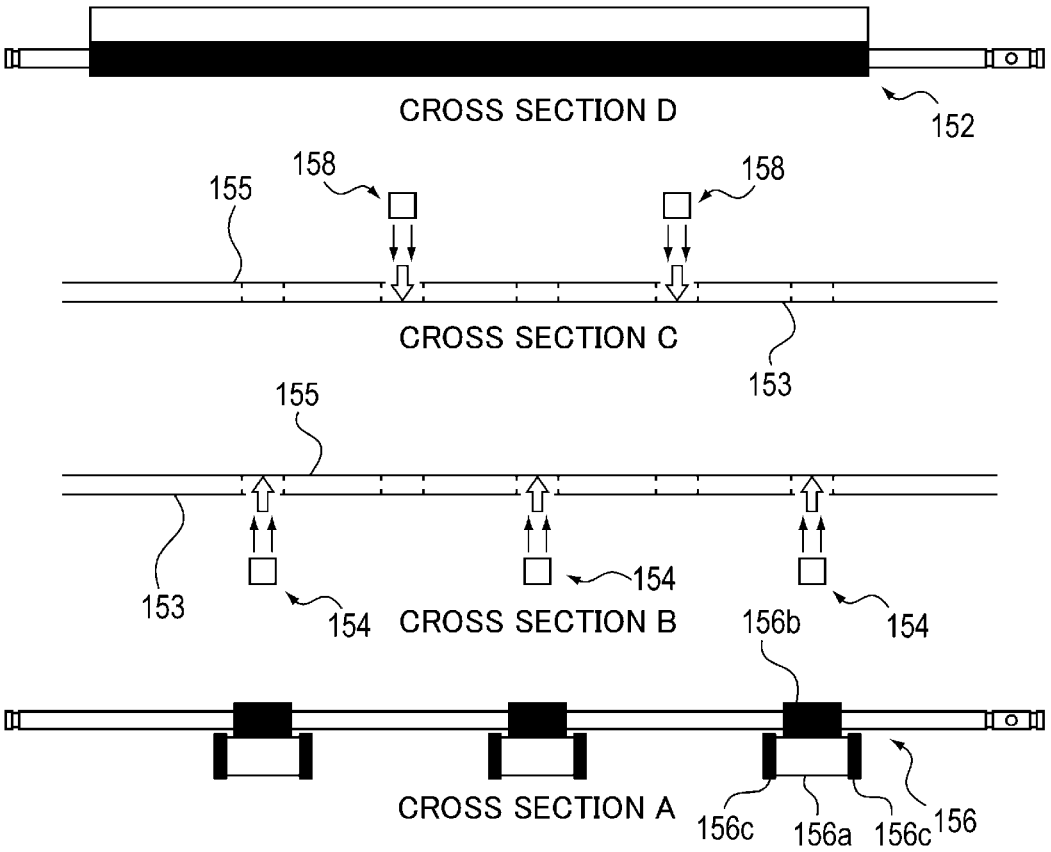

The discharging portion (sheet discharging device) that conveys the sheet that has passed through the fixing portion 150 and discharges the sheet onto the discharge trays 160 and 161 will be described with reference to the FIGS. 5A and 5B. FIG. 5A is a cross-sectional view showing the discharging portion according to the present embodiment. FIG. 5B includes cross-sectional views at the positions A, B, C and D of the discharging portion shown in FIG. 5A, which views are seen from the direction in which the sheet S is conveyed.

As shown in the cross-section C of FIG. 5B, between the conveying rollers 152 and the discharging rollers 156, the reverse surface cooling devices (first blowing units) 158 for blowing air at a plurality of locations in the width direction orthogonal to the sheet conveying direction are provided on the side of the outer guide 155. The reverse surface cooling devices 158 blow air from the side of the outer guide 155 (one guide member) toward the inner guide 153 (the other guide member) facing the outer guide 155. The obverse surface cooling devices (second blowing units) 154 that blow air to the sheet are provided between the conveying rollers 152 and the discharging rollers 156 on the side of the inner guide 153. The obverse surface cooling device 154 blows air to a plurality of locations different from those to which the reverse surface cooling device 158 blows air in the width direction orthogonal to the sheet conveying direction.

The conveying rollers 152 shown in the cross-section D of FIG. 5B and the discharging rollers 156 shown in the cross-section A of FIG. 5B respectively have the same configurations as those of the conveying rollers 152 shown in the cross-section C of FIG. 2B and the discharging rollers 156 shown in the cross-section A of FIG. 2B. Thus, the description for the conveying rollers 152 and the discharging rollers 156 is omitted.

In the discharging portion having the above-described configuration, the sheet S discharged from the fixing portion 150 is sent to the conveying rollers 152 and further conveyed by the conveying rollers 152. The sheet S conveyed by the conveying rollers 152 is introduced into a conveying path for discharging the sheet to the discharge tray 160 by the conveyance branch mechanism 151 while being guided by the inner guide 153 and the outer guide 155 which are opposed to each other. Thereafter, the sheet S is cooled by the obverse surface cooling devices 154 provided at a more inner position than the inner guide 153 and the reverse surface cooling devices 158 provided at a more outer position than the outer guide 155 and arranged alternately with the obverse surface cooling devices 154 while being guided by the inner guide 153 and the outer guide 155 which are opposed to each other. Then, the sheet S is discharged to the discharge tray 160 by the discharge rollers 156.

The obverse surface cooling device 154 and the reverse surface cooling device 158 are alternately arranged in the width direction. Therefore, when the sheet S is blown by the obverse surface cooling device 154 and the reverse surface cooling device 158, a corrugated shape is formed on the sheet S in the width direction orthogonal to the conveying direction, and the obverse surface cooling devices 154 blow air toward each ridged portion (each convex portion) of the corrugated shape of the sheet S. Thus, the blown air is guided by the corrugated shape of the sheet S, and is efficiently sent to the discharge tray 160 while suppressing dispersion in each direction.

As a result, the cooling effect of the air blown from the obverse surface cooling device 154 can be obtained not only in the conveying path by the inner guide 153 and the outer guide 155 but also on the discharge tray 160. Therefore, it is possible to reduce the temperature of the sheets on the discharge tray so that the problem that the sheets adhere to each other (melt-adhesion) can be suppressed.

Other Embodiments

In the above-described embodiments, at both ends of one roller of the discharging rollers 156, the ring members **156*c* whose outer diameter is larger than that of the one roller are provided to enlarge the corrugated shape of the sheet S. However, the present invention is not limited to this configuration. For example, only at one end of the one roller 156*a* of the discharging rollers 156 in the width direction, the ring member 156*c* whose outer diameter is larger than that of the roller 156*a*** may be provided. Alternatively, the effect of the present invention can be obtained without this ring member.

In the above-described embodiments, in order to more efficiently use the air blown from the obverse surface cooling device 154, the conveying rollers 152 are configured as a cylindrical roller that contacts the entire area of the sheet S in the width direction. The effect of the present invention can be obtained even if the conveying rollers 152 do not have this configuration.

Further, in the above-described embodiments, the discharging portion integrally provided in the image forming apparatus is exemplified as the sheet discharging device. However, the present invention is not limited to this configuration and the discharging portion may be detachably attachable to the image forming apparatus. Specifically, the same effect can be obtained in a sheet processing apparatus such as a finisher by applying the present invention to a discharging portion that conveys a sheet that has passed through a fixing portion and discharges the sheet to a stacking portion.

In the above-described embodiments, the printer is exemplified as the image forming apparatus. However, the present invention is not limited to this. For example, another type of image forming apparatus such as a copying machine, a facsimile apparatus, or a multifunction machine combining these functions may be used. Further, the present invention is not limited to an image forming apparatus that uses an intermediate transfer member, sequentially transfers toner images of respective colors onto the intermediate transfer member, and transfers the toner images born on the intermediate transfer member onto a sheet at a time. For example, the present invention may be applied to the image forming apparatus in which a sheet carrier is used, and toner images of respective colors are sequentially transferred and overlapped on a sheet carried on the sheet carrier. A similar effect can be obtained by applying the present invention to these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus, comprising:

a transferring portion configured to transfer a toner image onto a sheet;

a fixing unit configured to fix the toner image on the sheet;

a plurality of discharging rollers which discharge the sheet to a stacking portion;

a first guide member configured to guide one surface of the sheet downstream of the fixing unit in a sheet conveying direction and upstream of the plurality of discharging rollers in the sheet conveying direction;

a second guide member placed to face the first guide member, the second member being configured to guide the other surface of the sheet downstream of the fixing unit in the sheet conveying direction and upstream of the plurality of discharging rollers in the sheet conveying direction;

a plurality of protruded portions provided on the second guide member in a sheet width direction orthogonal to the sheet conveying direction, the plurality of protruded portions having openings through which air passes;

a plurality of recessed portions provided on the first guide member in the sheet width direction, the plurality of recessed portions being respectively located so as to face the plurality of protruded portions; and a blower unit which blows air toward the sheet via the openings provided on the protruded portions of the second guide member, wherein by the plurality of protruded portions provided on the second guide member and the plurality of recessed portions provided on the first guide member, a corrugated shape is formed in the width direction on the sheet to which air is blown, the plurality of recessed portions facing the plurality of protruded portions.

2. The image forming apparatus, according to claim 1, wherein the plurality of discharging rollers is a pair of rollers which nips and conveys the sheet, an outer diameter of either one of the rollers being not constant.

3. The image forming apparatus, according to claim 1, wherein the plurality of discharging rollers is a pair of rollers which nips and conveys the sheet, a member being attached to at least one end of either one of the rollers in the width direction, an outer diameter of the member being larger than that of the either one of the rollers.

4. The image forming apparatus, according to claim 1, wherein the discharging rollers are located above a position of an upstream end portion of a sheet stacking surface at the stacking portion in the sheet conveying direction, and wherein the second guide member is located below the first guide member which faces the second guide member at positions where the openings are provided.

5. An image forming apparatus, comprising:

a transferring portion configured to transfer a toner image onto a sheet;

a fixing unit configured to fix the toner image on the sheet;

conveying rollers configured to convey the sheet fixed by the fixing unit, the conveying rollers being configured to contact with substantially the entire area of the sheet in a width direction;

a plurality of discharging rollers which discharge the sheet conveyed by the conveying rollers to a stacking portion;

a first guide member configured to guide one surface of the sheet downstream of the conveying rollers in a sheet conveying direction and upstream of the plurality of discharging rollers in the sheet conveying direction;

a second guide member placed to face the first guide member, the second member being configured to guide the other surface of the sheet downstream of the conveying rollers in the sheet conveying direction and upstream of the plurality of discharging rollers in the sheet conveying direction;

a plurality of pressing members which press the sheet by protruding from the first guide member, the plurality of pressing members being provided at positions different from those of the plurality of the discharging rollers in a sheet width direction orthogonal to the sheet conveying direction; and a blower unit which blows air toward the sheet via openings provided on the second guide member, wherein by the plurality of discharging rollers and the plurality of pressing members, a corrugated shape is formed in the width direction on the sheet to which air is blown.

6. The image forming apparatus, according to claim 5, further comprising:

a conveyance branch mechanism which selects one from a conveying path to the discharging rollers and a duplex conveying path as a conveying path through which the sheet which has passed the fixing unit is conveyed, wherein the discharging rollers, the pressing members, and the openings are provided downstream of the conveyance branch mechanism in the sheet conveying direction.

7. The image forming apparatus, according to claim 5, wherein a plurality of ribs is provided on the second guide member in the sheet width direction, the plurality of ribs extending in the sheet conveying direction, and wherein each of the openings is provided between two of the plurality of ribs.

8. The image forming apparatus, according to claim 5, wherein the plurality of discharging rollers is a pair of rollers which nips and conveys the sheet, an outer diameter of either one of the rollers being not constant.

9. The image forming apparatus, according to claim 5, wherein the plurality of discharging rollers is a pair of rollers which nips and conveys the sheet, a member being attached to at least one end of either one of the rollers in the width direction, an outer diameter of the member being larger than that of the either one of the rollers.

10. The image forming apparatus, according to claim 5, wherein the discharging rollers are located above a position of an upstream end portion of a sheet stacking surface at the stacking portion in the sheet conveying direction, and wherein the second guide member is located below the first guide member which faces the second guide member at positions where the openings are provided.

* * * * *